United States Patent [19]

Smith et al.

[11] Patent Number: 4,976,673

[45] Date of Patent: Dec. 11, 1990

[54] APPARATUS AND METHOD FOR THE PRODUCTION OF FLEXIBLE BAGS

[75] Inventors: David A. Smith, Midland; Albert C. Dowell, Mt. Pleasant; Herbert B. Geiger, Bay City, all of Mich.

[73] Assignee: Dow Brands Inc., Indianapolis, Ind.

[21] Appl. No.: 411,423

[22] Filed: Sep. 22, 1989

[51] Int. Cl.[5] ..... B31B 23/16; B31B 23/64

[52] U.S. Cl. ..... 493/194; 493/205; 493/208

[58] Field of Search ..... 493/193, 194, 195, 196, 493/197, 205, 208

[56] References Cited

U.S. PATENT DOCUMENTS

| | | | |
|---|---|---|---|
| Re. 28,172 | 9/1974 | Bradley et al. . | |
| 2,737,859 | 2/1952 | Allison et al. . | |
| 3,254,889 | 6/1966 | Nystrand . | |
| 3,599,705 | 8/1971 | McDougal et al. . | |
| 3,640,050 | 2/1972 | Nystrand et al. . | |
| 3,842,568 | 10/1974 | Spencer . | |
| 3,901,754 | 8/1975 | Simpson et al. . | |
| 4,115,183 | 9/1978 | Achelpohl et al. . | |
| 4,331,502 | 5/1982 | Achelpohl et al. . | |
| 4,396,449 | 8/1983 | Tumminia et al. . | |
| 4,436,576 | 3/1984 | Seiden | 156/543 |
| 4,464,219 | 8/1984 | Colombo et al. | 493/205 |
| 4,557,713 | 12/1985 | Savich . | |
| 4,609,367 | 9/1986 | Savich et al. . | |

*Primary Examiner*—William E. Terrell

[57] ABSTRACT

An apparatus for the continuous production of individual flexible products from a folded web of material, in particular, heat sealable thermoplastic material, is described having improved means for providing tension relief in such web material, and for tucking such web material outwardly from the surface of the product drum. The tuck rolls remain extended above the surface of the product drum throughout product drum rotation, and are retracted by cam arrangement to provide tension relief. Three alternative support assemblies and related cam arrangements are disclosed, two of which employ adjustable, compressible tuck roll support assemblies.

62 Claims, 12 Drawing Sheets

APPARATUS AND METHOD FOR THE PRODUCTION OF FLEXIBLE BAGS

CROSS-REFERENCE TO RELATED APPLICATIONS

This application is related to commonly assigned U.S. applications Ser. No. 353,932, filed May 19, 1989, pending; Ser. No. 200,283, filed May 31, 1988, U.S. Pat. No. 4,911,423; and Ser. No. 159,133, filed Feb. 23, 1988, U.S. Pat. No. 4,917,415.

BACKGROUND OF THE INVENTION

This invention relates to an apparatus and method for making individual flexible web products, and, in particular, to an apparatus and method for producing bags of different widths from a folded web of heat sealable thermoplastic material.

In the production of individual flexible web products such as plastic bags and containers, the bag stock is typically supplied in the form of a continuous web of thermoplastic material which has been folded upon, itself to form two plies. In forming individual plastic bags and containers, portions of the thermoplastic material are severed from the web. These severed areas also become side seams for the bags because they are typically sealed at the same time as they are severed by the use of a heated wire element. The plastic bags are then stacked, counted, and packaged by packing equipment.

The severing and sealing operation typically takes places on a relatively large diameter rotating drum which may contain multiple heated wire severing and sealing elements positioned in grooves located within the outer periphery of the drum. See, for example, Tumminia Patent No. 4,369,449, assigned to the same assignee as the present invention. As the drum rotates through a given arc, different severing and sealing elements are actuated and raised up to the drum surface to sever and seal a respective portion of the web of bag stock. The individual bags are retained on the drum by a vacuum arrangement as the drum rotates. Such drums are large and expensive pieces of equipment.

Individual bags are then taken from the drum, stacked, and packaged. See, for example, U.S. Pat. Nos. Re 28,172, 3,254,889, 3,599,705, 3,640,050, and 3,842,568, for a description of typical stacking and packing apparatus. Desirably, the packaging operation occurs at the highest possible speed at which the equipment can be operated to increase productivity of the system. As shown in the above mentioned patents, presently, individual bags are taken from the drum by a smaller drum, also suitably equipped with vacuum capabilities. The vacuum on the bags on the large drum is relieved at an appropriate point, and the bags fall onto the smaller drum where they are held in position by vacuum. At an appropriate point, the vacuum is released and the individual bags are pulled off the smaller drum by an orbital packer or similar device.

Early rotary drum apparatuses provided for cutting bags at fixed intervals on a smooth drum, e.g. Allison, U.S. Pat. No. 2,737,859, permitting production of one bag size. Since then the versatility of bag making machines has been improved to permit the production of a variety of bag widths on one machine. Improvements in mass production rates have also been sought. The machines disclosed in U.S. Pat. Nos. 3,901,754, 4,115,183 and 4,331,502 use two sets of support rollers which separate and tuck the web of thermoelastic material radially inward into a zig-zag shape before cutting and sealing along one set of spring-mounted supports. Bag width can be adjusted by changing the separation between the two sets of support rollers. In the '754 machine, the supports are fixed on two nested drums. Bag width is changed by adjusting the axis of rotation of smaller drum 15, thereby altering, within limits, the relationship between the rods and bars which separate from a point of intersection between the drums to form the tuck. Bag width may also be varied by removing intermediate rods or bars. In the '183 and '502 machines, where both sets of bars are on the same drum, bag size may be varied only by changing the cam plate which controls the motion of bars which are drawn radially inward by spring tension to form the tuck. While these machines permit continuous bag production at high rates, their drawback is that they have many moving parts.

U.S. Pat. Nos. 4,557,713 and 4,609,367, employ adjustable tuck bars to tuck the web material radially outward rather than inward. The depth of tuck and tension relief is controlled by a cam track. No springs are used to effect tucking or tension relief in the web. Infinite variation of bag size is possible within dimensional limits of these machines by adjusting the cam track which controls tuck bar movement. As the product drum rotates through a complete cycle, the tuck bars extend radially outward to tuck the web, and retract inside the drum periphery to allow product transfer. Again, however, the '713 and '367 machines also have the drawback of many moving parts which can wear and require maintenance. Precision in bag width, therefore, continues to be of concern. Additionally, transfer and stacking problems occur with larger bag sizes on the '713 and '367 machines due to instantaneous acceleration of the bags at the point of transfer between the product drum and transfer drum, a problem discussed in more detail below.

When the thermoplastic material is severed and sealed, the resulting bag seams remain hot even as the bags pass from the large product drum to the transfer drum. Thus, when looped or tucked material is removed from the product drum and laid flat on the transfer drum, the bag seals may overlap and reweld. One solution has been, for example with U.S. Pat. Nos. 4,557,715 and 4,608,367, to increase the rotational speed of the transfer drum to create space between the bag seams on the transfer drum. However, because the transfer drum is required to rotate at a tangential velocity higher than that of the seal drum, the bags are subjected to instantaneous acceleration at the point of transfer. Transfer and stacking problems result, particularly with larger sized bags.

Also presenting bag sealing problems is the tendency of the thermoplastic material to melt back when cut by the hot sealing wires. It has been found that relieving tension in the thermoplastic web material permits the bag welds to seal more completely. New means to provide such relief have been sought. Thus, for example, cam tracks have been designed to cause the tuck bars of U.S. Pat. Nos. 4,557,713 and 4,609,367 and supports of U.S. Pat. No. 4,331,502 to retract slightly at the time of sealing to provide tension relief and improve the bag weld seal.

The need continues, therefore, for high volume production machines which achieve size adjustment with a minimum of moving parts. The wear on numerous moving parts presents problems in maintaining bag width precision, general maintenance, and repair. Sealing problems have been addressed by providing tension relief through machine design, and by maintaining weld separation between bags. The need to maintain bag weld separation requires further development to avoid transfer and stacking problems.

SUMMARY OF THE INVENTION

The present invention meets those needs by providing a simple means to vary product width. The invention also discloses improved means for tension relief and transfer drum improvements for maintaining bag weld separation.

According to one aspect of the present invention, a folded web of thermoplastic material is continuously fed onto the surface of a rotatable product drum having a plurality of conventional sever and seal stations located about its outer periphery for forming individual bags. Positioned between adjacent sever and seal stations are means for tucking the web of material outwardly from the periphery of the product drum. In the first two embodiments, the means for tucking are tuck rolls which extend beyond the surface of the drum throughout drum rotation, but are capable of compression below the drum periphery. The tuck rolls are supported by assemblies which include a bracket, bearing housing, and spring. It is the spring which biases the rolls to their outermost position, yet permits the desired compression feature. The preferred embodiment contemplates including additional features in the support assembly. One end of the brackets preferably includes a bearing block in which the tuck roll is rotatably mounted, and the other end of the bracket includes an adjustable stop plate. Bearings are also disposed in the bearing housing. Also preferred are a means to detect unintended compression of the tuck roll below the surface of the drum as a safety feature. Such may occur when product and transfer drums are out of time.

In a third embodiment, the tuck rolls extend similarly, but are rigid, capable of compression only in an alternative embodiment which incorporates a nested spring in the tuck roll support assembly.

In the first two embodiments, variation in height of the tuck rolls may be achieved by mounting the tuck roll support assemblies at different locations on the product drum wall, thereby changing the depth of the tuck, and changing the size of the product formed on the product drum. Alternatively, change parts (bracket or bearing block) or adjustable parts (bracket or adjustable stop plate) could be used to change the effective length of the tuck roll support assembly. Preferably, such change is accomplished by replacing the bearing block. Regardless, the support assemblies preferably also include a means for making fine adjustments in tuck roll height, such as the adjustable stop plate. In the third embodiment, change parts or, alternatively, adjustable sections of the tuck roll support assemblies, such as the bracket, bearing block or adjustable stop plate, permit change in the effective length of the support assembly and thereby change the depth of tuck and size of the products produced.

These simplifications in design reflect a recognition of the need for producing only certain discrete bag sizes and reverse the trend towards complexity of design. Moving parts are minimized, eliminating associated adjustment problems, improving control of product width, and resulting in greater product uniformity.

Also incorporated in the design of the present invention is a means of providing simple tension relief in the web material during the severing and sealing operation. In the first embodiment, cam followers are attached to each tuck roll support assembly bracket and engage a cam plate. This engagement causes the brackets to move radially inward and compress the support assembly spring. This action provides tension relief in the web over a defined arc of drum rotation. In the second embodiment, cam followers are attached to the seal bar assemblies and engage a cam plate, providing tension relief over a defined area in similar fashion. In the third embodiment, the cam followers are again attached to each tuck roll support assembly, but now are located in a continuous cam track and control the position of the tuck rolls at all times. The cam track is therefore cut to provide tension relief in the web over the desired arc of drum rotation. Following severing and sealing of the web material, each embodiment provides for retention of the individual flexible products on the product drum by vacuum ports located on both sides of the tuck rolls.

The present invention also includes means for transferring individual ones of the products from the product drum to a delivery point by means of a rotatable vacuum transfer drum having conventional means for vacuum retention of the flexible products on their leading edges by the first of two vacuum manifolds. The transfer drum has a series of indentations on its surface corresponding in depth with the tuck rolls on the product drum so that the indentations mate with the tuck rolls as the product and transfer drums rotate. The indentations have a profile designed to match the web contour when clamped over the tuck roll at its furthest extension. Preferably, the indentations removably receive inserts and spacer blocks of different discrete sizes to correspond with tuck roll height. The indentations include vacuum ports communicating with the second vacuum manifold and securing the flexible products therein to prevent rewelding of adjacent bag seams while the transfer drum rotates through a given arc. Means for subsequently urging the individual products outwardly from the indentations prior to their reaching a delivery point preferably include fixed guides which may, in combination with positive air pressure introduced through ports in the indentations, cause the flexible products to flatten for stacking. Alternatively, mechanical friction means, such as eccentric wheels, drag the trailing edges of the products and urge them to flatten out.

In a further embodiment, two transfer drums are used as first described above. The first transfer drum operates as described, however, the second transfer drum accepts alternate ones of the flexible products from the first transfer drum, and delivers them to a second delivery point. Such an arrangement permits the individual flexible products to flatten out on their respective transfer drums without interference from adjacent products, eliminating stacking and delivery problems.

In an alternative embodiment of the invention, a single transfer drum includes a plurality of alternating first and second segments, where the first segments are movable transverse to the path of movement of the products, that is, transverse to the direction of rotation of the transfer drum. The first segments are adapted to accept alternating flexible products from the product drum and include vacuum ports for securing the leading edges and mid-sections thereof. Preferred in this alternative embodiment, the flexible products on the first segment are also secured at their trailing edges by vacuum ports in communication with the second vacuum manifold. The second segments, which do not move transverse to the path of movement of the products, are adapted to accept alternating ones of the flexible products and also include vacuum ports for securing the leading edges and mid-sections thereof. The lateral shifting of the first segment of the transfer drum resolves problems associated with drastically different product drum and transfer drum surface speeds. Further, in the production of thermoplastic bags, by spreading out adjoining bags on the transfer drum, the shifting also prevents rewelding of adjacent bag seals. Ultimately, the first segments of the transfer drum provide flexible products to a first delivery point, and the second segments provide flexible products to a second delivery point.

In the preferred embodiment, a plurality of rotatable vacuum transfer drums are positioned about the periphery of the product drum for transfer of individual flexible products from a plurality of transfer points to a plurality of corresponding delivery points. The transfer means further include means for rotating those drums. At the delivery points, the products are stacked, counted, and packaged by machinery such as an orbital packaging apparatus. The drums are so arranged that the first of the transfer drums accepts individual products from the product drum at the first transfer point, while succeeding transfer drums accept products from the product drum at succeeding transfer points. Each transfer drum has indentations, cavity inserts and spacer blocks as described above.

At each transfer drum, at least a portion of the products on the product drum are transferred by means of a vacuum arrangement on the drums as described above. Vacuum sources in each drum communicate with vacuum ports which extend radially outwardly from the interior of the drums and retain the flexible products at their leading edges and midsections on the drum surface. By taking alternate ones of the flexible products, the preferred embodiment insures that, in the production of thermoplastic bags, bags will not reweld to adjacent bag seals when flattening out on the transfer drum for delivery. The products on the transfer drum are then themselves delivered, by rotation of the drum, to a respective delivery point. The transfer drums are designed to remove individual products from the product drum as it rotates so that after the last transfer drum is reached, all products have been transferred.

In conventional packaging systems, the maximum number of products which can be produced is limited by the capabilities of the packaging portion of the system. By providing a plurality of delivery points, the number of packaging apparatuses can be increased for a single product drum. This enables the product drum to be operated at much higher speeds. In this manner, the effective speed of the delivery system can be doubled or tripled without exceeding the design specifications of the packaging equipment. Additionally, where downtime and maintenance costs are excessive for packaging systems operated at the design limits of such systems, the preferred transfer and delivery system of the present invention permits increases in overall production rates while actually operating the packaging equipment at lower speeds than before.

The various transfer drum improvements may also find application with existing flexible product manufacturing apparatuses. For example, in the production of thermoplastic bags, once bags are delivered to the transfer drum, for example, delivered flat from a smooth-surfaced product drum, the indentations on the transfer drum surface can provide a tuck in individual bags which will separate and prevent rewelding of adjacent bag seals; lateral shifting will spread out bags on the transfer drum to separate bag seals; and/or a plurality of transfer drums will separate bag seals and permit higher production rates.

Finally, a method for the continuous production of flexible products, such as plastic containers and bags made from a folded web of thermoplastic material, is provided. The method includes the steps of providing a source of a continuous web of the material, continuously feeding the web onto the surface of a rotating product drum, and tucking the web outwardly over compressible tuck rolls extending above the surface of the product drum, after which the web is severed and sealed to form individual flexible products. A further aspect of the method is the transfer of the products to the surface of a rotating transfer drum having indentations in its surface mating with the projections on the product drum, following which the products are urged outwardly from those indentations and delivered to a delivery point. This further aspect of the method may also, separately, find application in transferring and delivering flexible products produced by existing methods.

Accordingly, it is an object of the present invention to provide an apparatus and improved method for producing and varying the width of individual flexible products on a high volume production system without machine and product problems experienced in the prior art. In particular the invention addresses problems providing tension relief, size, adjustment and transfer and stacking of individual flexible products. These and other objects and advantages of the system will become apparent from the following detailed description, the accompanying drawings, and the appended claims.

DESCRIPTION OF THE PREFERRED EMBODIMENTS

Figure 1:
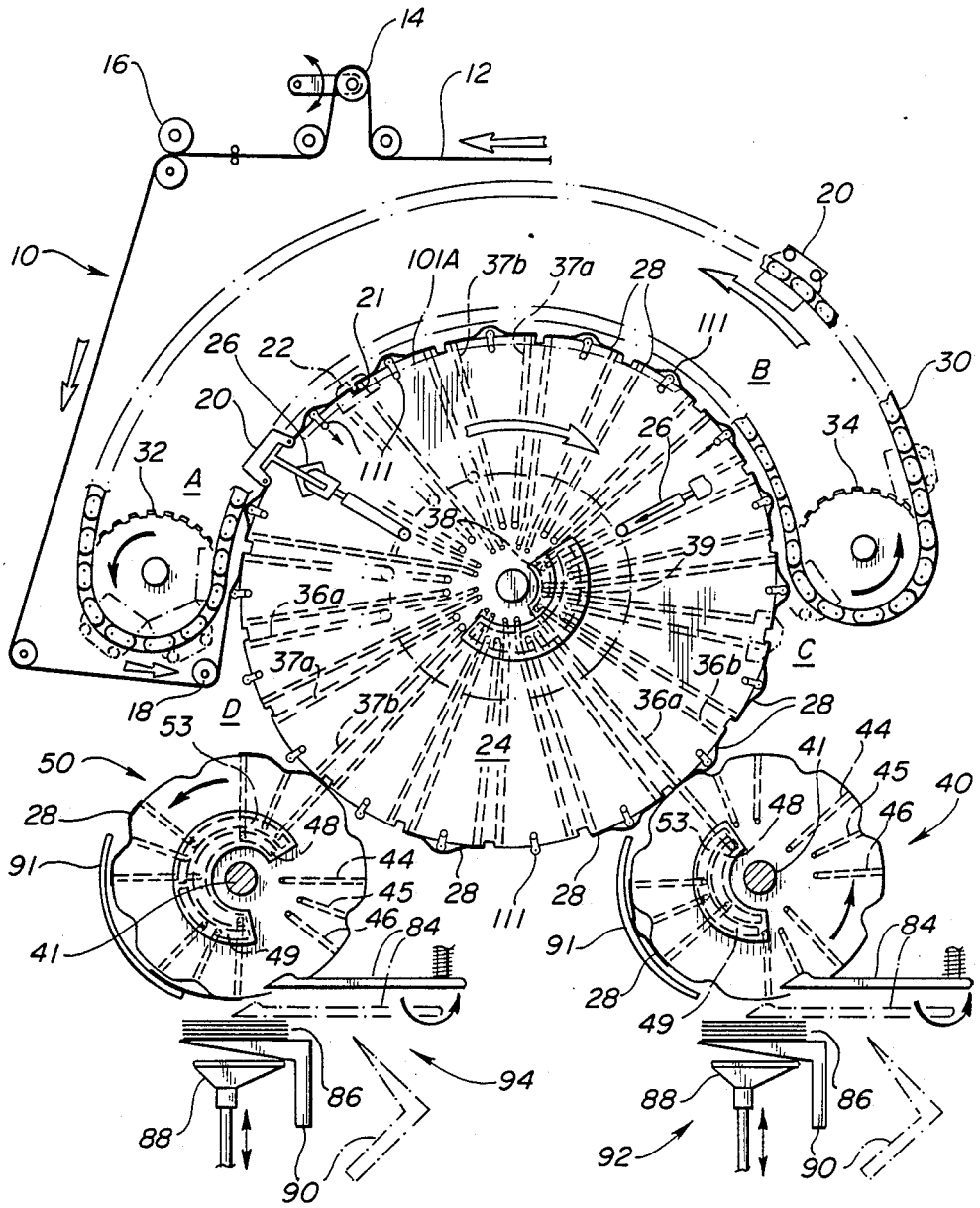
FIG. 1 is a schematic side elevational view of the preferred embodiment of the apparatus of the present invention.

Referring now to FIG. 1, the apparatus and method of the present invention is illustrated in schematic form in its multiple transfer drum delivery embodiment. Delivery system 10 receives a continuous film web 12 from a spool (not shown) or directly from an extrusion line. While the invention will be described in the context of a thermoplastic film web used to form individual bags or containers, it will be apparent to those skilled in the art that the apparatus and method of the present invention is applicable to other flexible products which are fed from a continuous web and then divided into individual products. For example, a variety of thin, flexible paper or plastic products such as paper napkins and towels may be produced and delivered to packaging equipment by the apparatus and method of the present invention.

Web 12 may either be a zippered or unzippered bag stock being folded on itself to provide a two ply film. Web 12 is caused to pass over dancer roll 14 which acts to control film web tension based on its vertical positioning. Web 12 is then pulled through a draw-roll arrangement 16 which is driven at a speed slightly in excess of the rotational speed of product drum 24. This type of operation permits some slack in the film as it is being fed onto product drum 24. Drum 24 is designed to process two side-by-side plastic film webs simultaneously, although only a single web is shown. However, the invention is also applicable to a single stream of individual flexible products on the product drum. For ease of understanding, the invention will be explained with reference to a single stream of flexible products.

The web 12 then passes over a lay-on roll 18 which is located to position the film web against the seal bar assembly which then lays the web against the surface of the rotating product drum. If zippered film is being utilized, lay-on roll 18 will have a groove appropriately positioned thereon to accommodate and guide the zippered portion of the film web onto the product drum.

Figure 6:
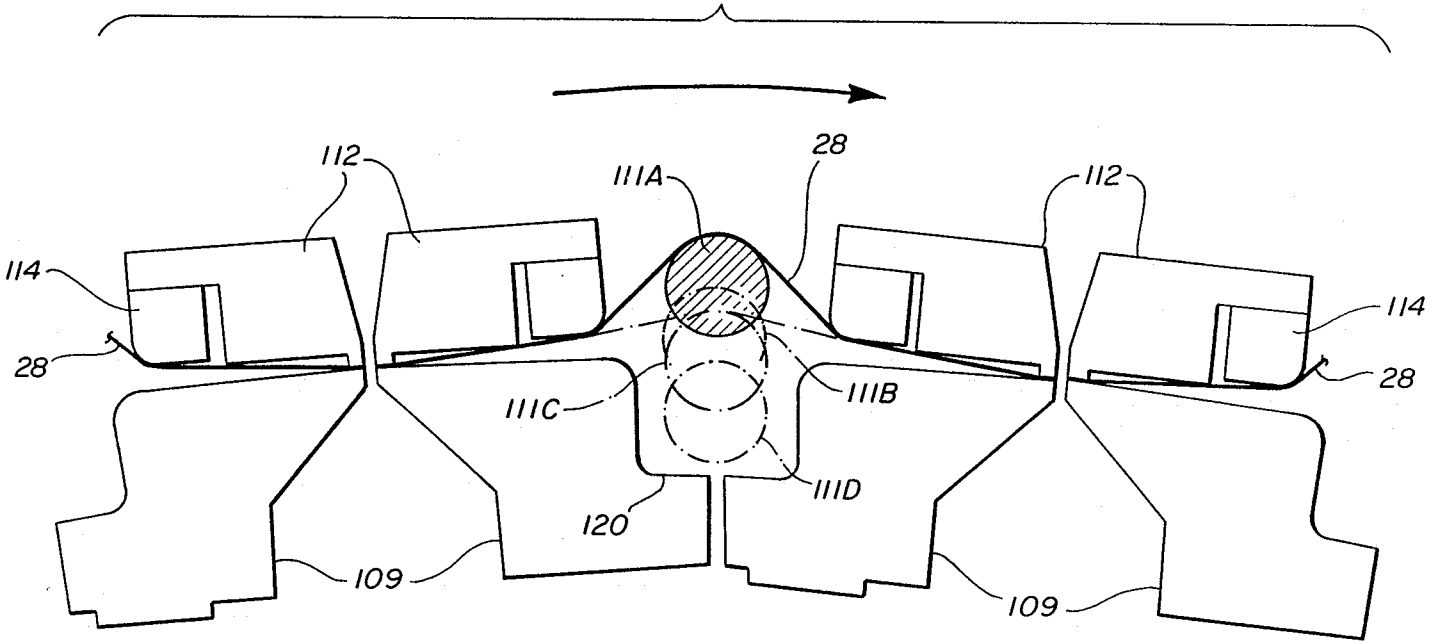
FIG. 6 is an enlarged schematic view of a tuck roll and seal bar assemblies taken at any roll between positions A and B of FIG. 1.
Figure 7:
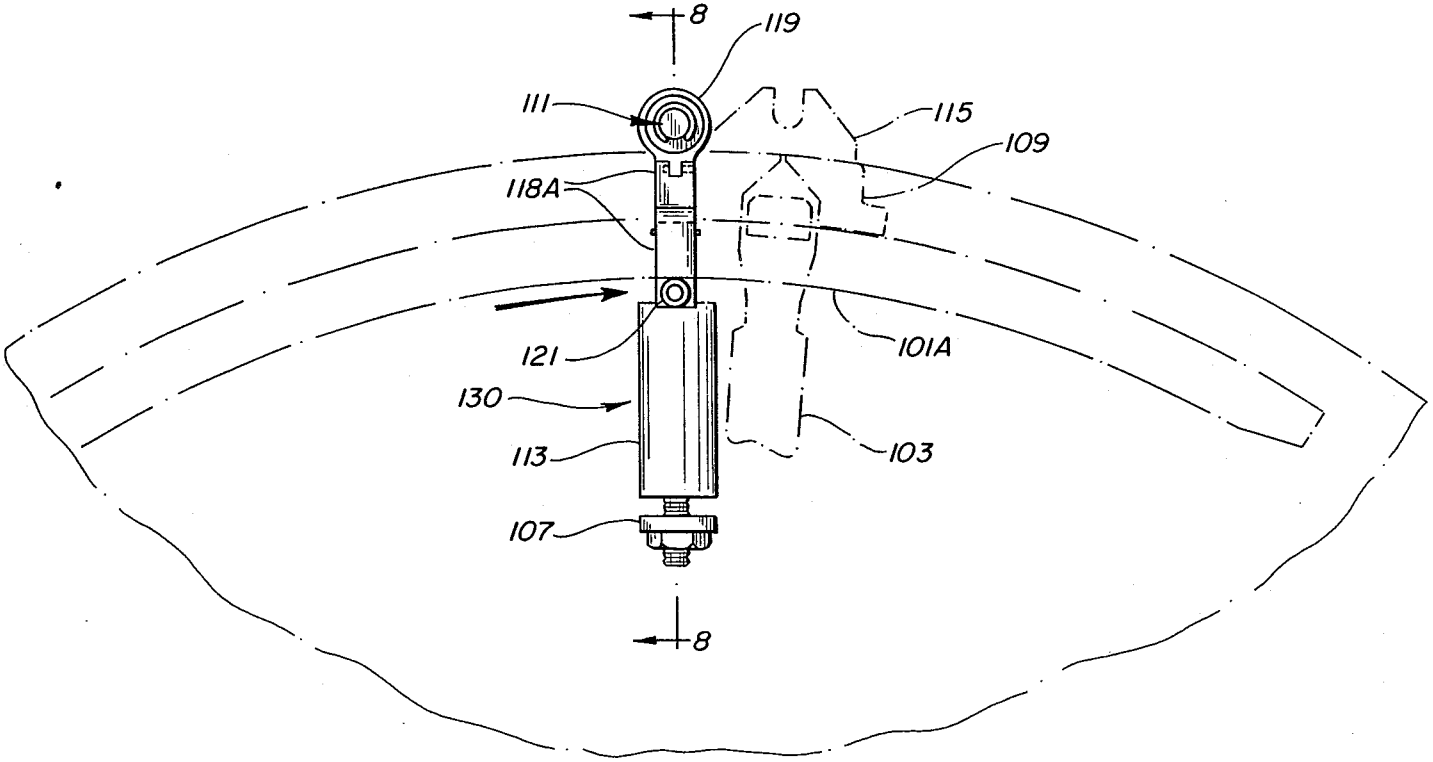
FIG. 7 is an enlarged view of a tuck roll support assembly, related means of adjustment and preferred means for tension relief at any tuck roll between positions A and B of FIG. 1.
Figure 8:
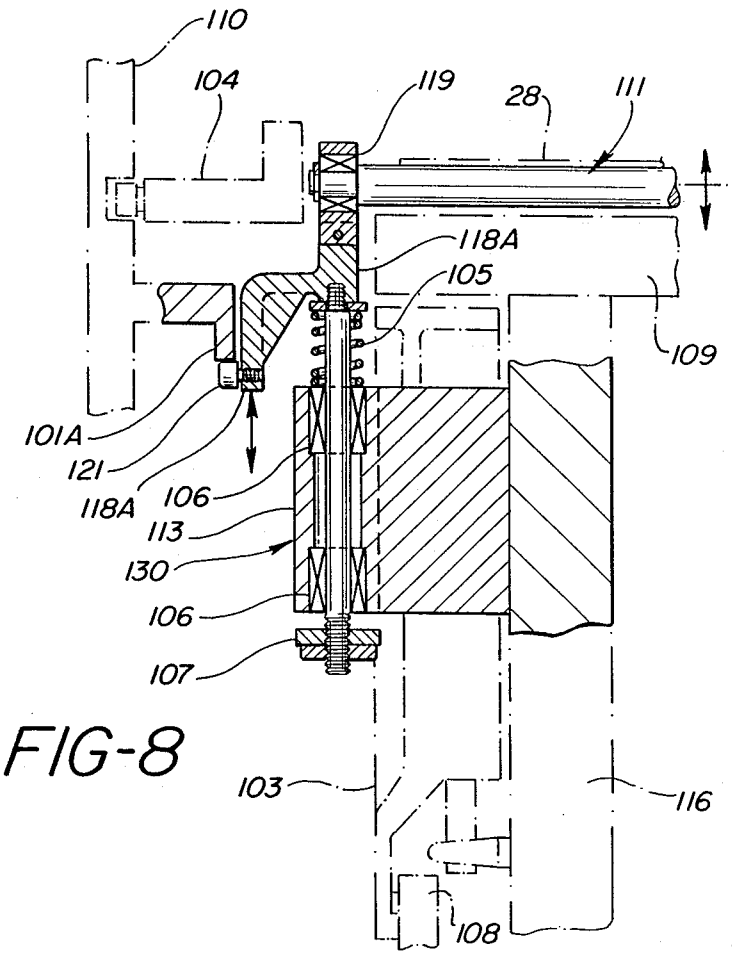
FIG. 8 is an enlarged cross-sectional view in cross-section of the preferred means for tucking taken along line 8—8 in FIG. 7.
Figure 7A:
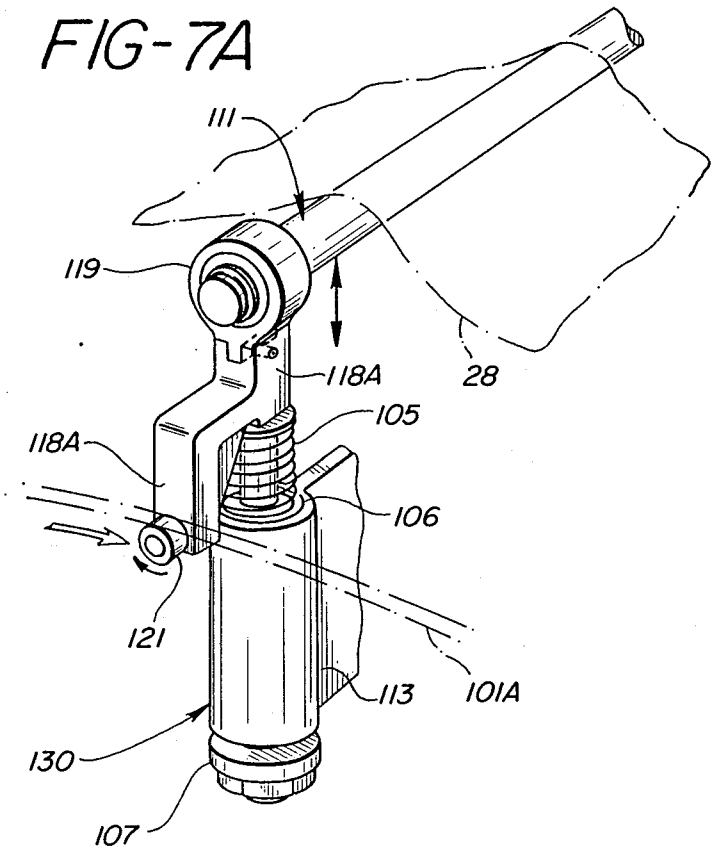
FIG. 7A is a perspective view of the preferred embodiment of FIG. 7.

Web 12 is then severed and sealed on product drum 24 in the following manner. Web 12 is clamped tightly to the outer surface of product drum 24 between tuck rolls 111 at a severing and sealing edge of a heating element slot 21 by seal bar assembly 20. Seal bar assembly 20 is aligned in proper position through the use of yokes 22 on the product drum 24 and also contacts the web at pivot shafts 114, shown best in FIG. 6. Pivot shafts 114 will have a groove to accommodate zippered film stock, and at least one rounded edge for contact with web 12. Tuck rolls 111 are located between the seal bar assemblies. As product drum 24 rotates in the direction of the arrow, tension in the web 12 is first relieved by retracting tuck roll 111 as best shown in FIG. 6. Then, a heated wire severing and sealing element, shown generally at 26 in FIG. 1 and operable through a conventional cam assembly (not shown) emerges from a recess in product drum 24 and severs web 12 at position A.

The severing and sealing element remains extended for approximately 120 degrees of rotation of the product drum until the severing and sealing element 26 is withdrawn as shown schematically at position B. During the time that the element is extended, the film melts back to the edge of the seal bar assembly 20 and a bead seal forms on the edge of the bag. Individual bags 28 are formed by the severing and sealing of the film web on adjacent seal bar assemblies. Tuck roll 111 remains retracted until reaching position B where it begins to return to full extension before seal bar assembly 20 is removed at C. Tuck roll 111 remains extended until again contacting web 12.

Just prior to the release of the clamping force of the seal bar assembly 20, a vacuum is applied to the leading and trailing edges of individual bags 28. Seal bar assembly 20 is removed from the product drum by a continuous chain drive 30 having sprockets 32 and 34 located on opposite sides of product drum 24. The chain drive permits precise positioning of the individual seal bar assemblies 20 along the surface of the product drum.

Referring now to FIGS. 6, 7, 7A and 8, the structure and operation of the tuck rolls 111 on the product drum 24 in the preferred embodiment are illustrated in greater detail. The tuck roll 111 is supported by two support assemblies 130 attached to opposing side plates of the drum 24 by conventional means.

The support assemblies 130 (only one is shown) include a bracket 118A, bearing housing 113 and spring 105. Tuck roll 111 is mounted in tuck roll bearing block 119 attached at the outermost end of bracket 118A. Bracket 118A is slidably inserted into bearings 106 and bearing housing 113. Spring 105 is compressibly nested around the bracket 118A and biases tuck roll 111 to its outermost position. Extension of tuck roll 111 may be finely adjusted with stop plate 107 attached to the innermost end of bracket 118A, where bracket 118A may be threaded to accommodate such adjustment. Tension relief in the film 12 is provided by mechanical means. Cam follower 121, connected to bracket 118A, contacts crescent-shaped cam 101A shown in FIGS. 7A and 8 as the product drum 24 rotates from position A to position C, retracting the tuck roll 111 to tension relief position 111B or 111D depending on the bag size provided.

Tuck roller extension may be adjusted from position 111A to 111C, as shown in FIG. 6, to change the bag size produced from wide to narrow. This is accomplished, preferably by replacing tuck roll bearing block 119. Alternatively, stop plate 107 may be adjusted to retract tuck roll 111 inward to position 111C; bearing housing 113 may be relocated inward, changing the location of tuck roll support assembly; a spacer may be placed at stop plate 107 (not shown); or a segment of bracket 118A may be removed (not shown). These alternatives would also require relocation of cam follower 121 on bracket 118A to provide the desired Contact with cam 101A.

As a final alternative, tuck roller extension may be adjusted from position 111A to 111C, by relocating cam follower 121 upward on bracket 118A and providing that crescent-shaped cam 101A extends over 180 degrees (not shown) of drum rotation. As a result, the tuck rolls would remain retracted until the seal bar assemblies 104 pull away from contact with the web 12 at C. With this final alternative, the tuck rolls would always return to position 111A, regardless of bag size, while the product drum rotates from point C to D for transfer and delivery of the bags.

Preferably, a tuck roll depression sensor, such as a standard proximity switch, will detect unintended depression of the tuck roll 111 below the surface of product drum 24 as a safety feature. Such depression may occur if the product and transfer drums come out of time.

Figure 9:
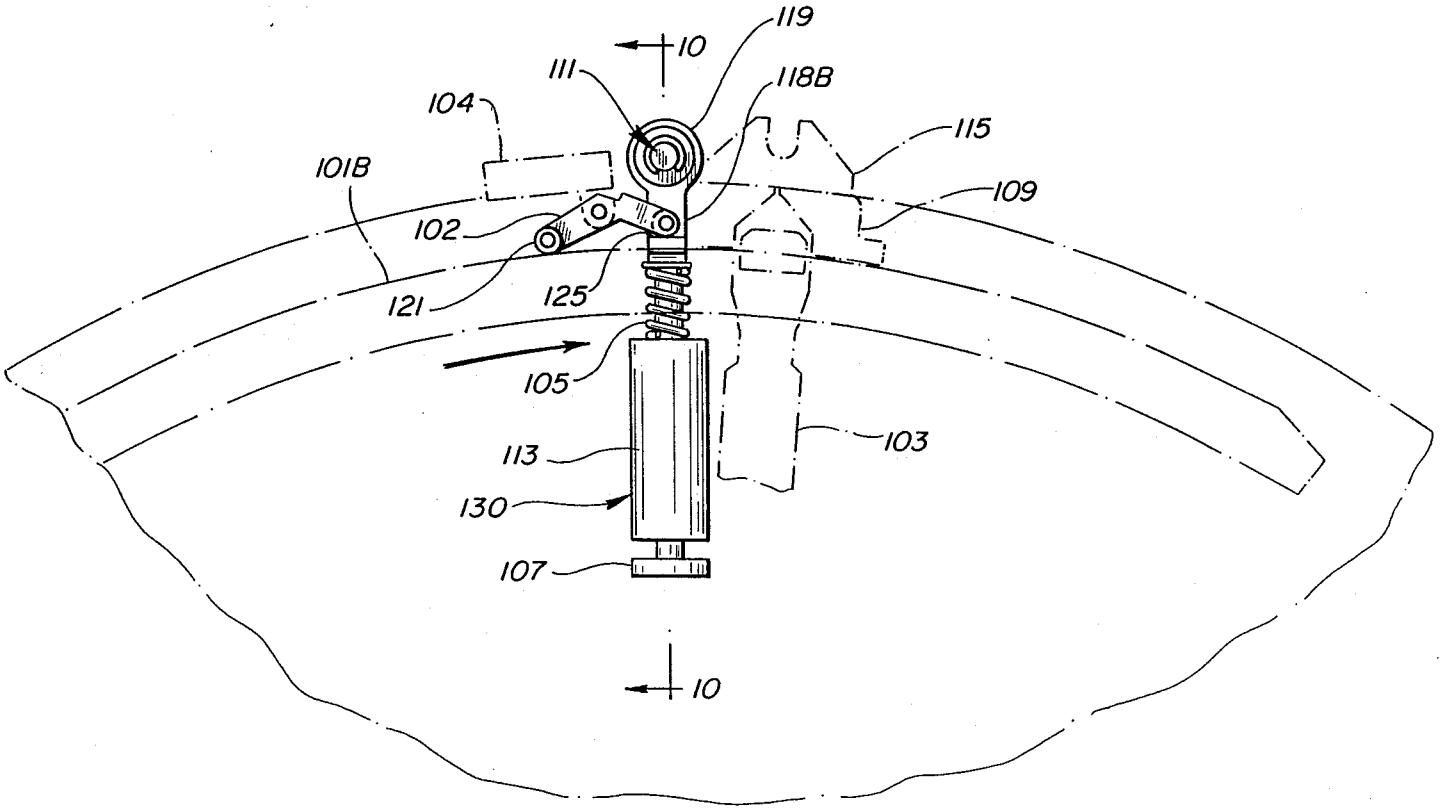
FIG. 9 is an alternative embodiment of the tuck roll support assembly and means for tension relief of FIG. 1.
Figure 10:
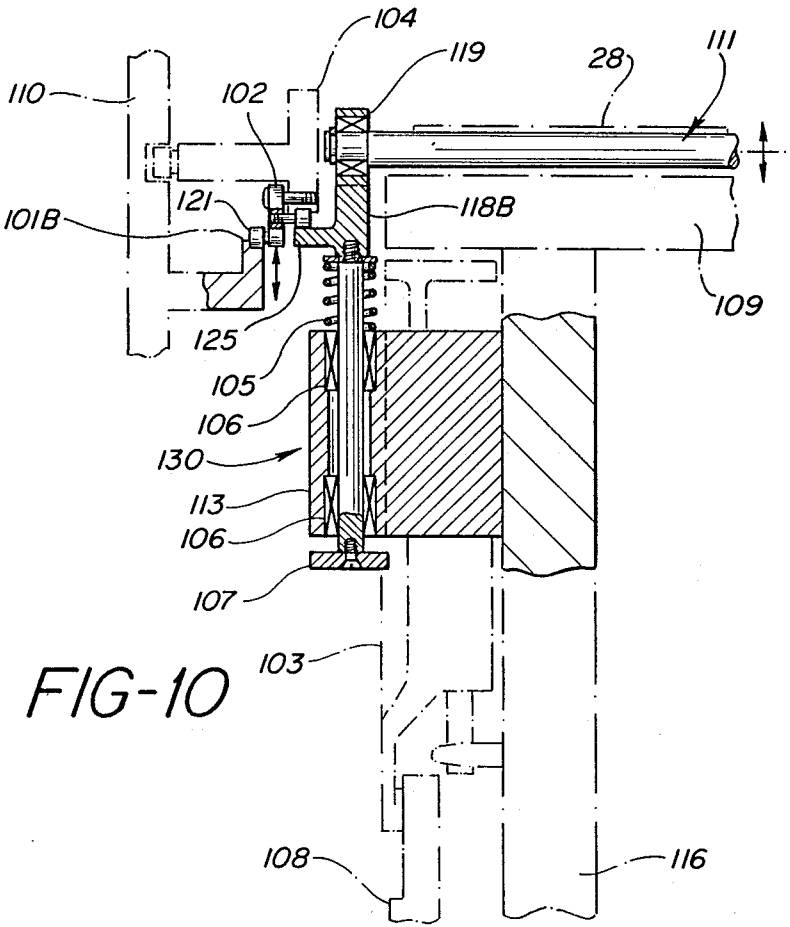
FIG. 10 is a cross-sectional view taken along line 10—10 in FIG. 9.

In a second, alternative embodiment of the means for providing tension relief, shown in FIGS. 9 and 10, the function of cam follower 121 to retract tuck roll 111 is performed by cam follower arm 102. That is, cam follower arm 102, attached to seal bar assembly 104, is brought into contact with crescent-shaped cam 101B. Cam follower 102 is thereby caused to pivot and contact bearing surface 125 of bracket 118B, causing tuck roll 111 to retract. Adjustment of tuck roll extension from position 111A to 111C may be achieved in similar fashion as described above.

Figure 11:
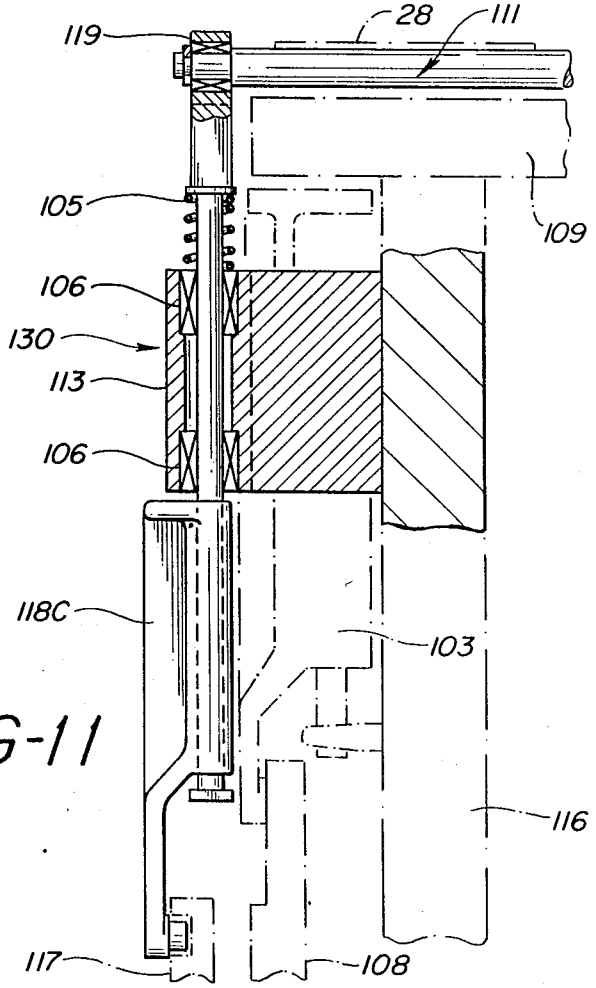
FIG. 11 is an alternative embodiment of a tuck roll support assembly.

In a third, alternative embodiment, shown in FIG. 11, bracket 118C extends to track cam 117 which controls the position of tuck rolls 111 over the entire 360° of drum rotation. Tuck roll position may be adjusted from 111A to 111C in similar fashion as described above with change parts or adjustable parts such as bearing block 119 or bracket 118C. A further modification of this alternative embodiment includes nested spring 105, as also shown in FIGS. 7–10, to render the tuck rolls compressible, and adaption of bracket 118 for adjustability with a stop plate 107 as also shown in FIGS. 7–10.

Figure 2:
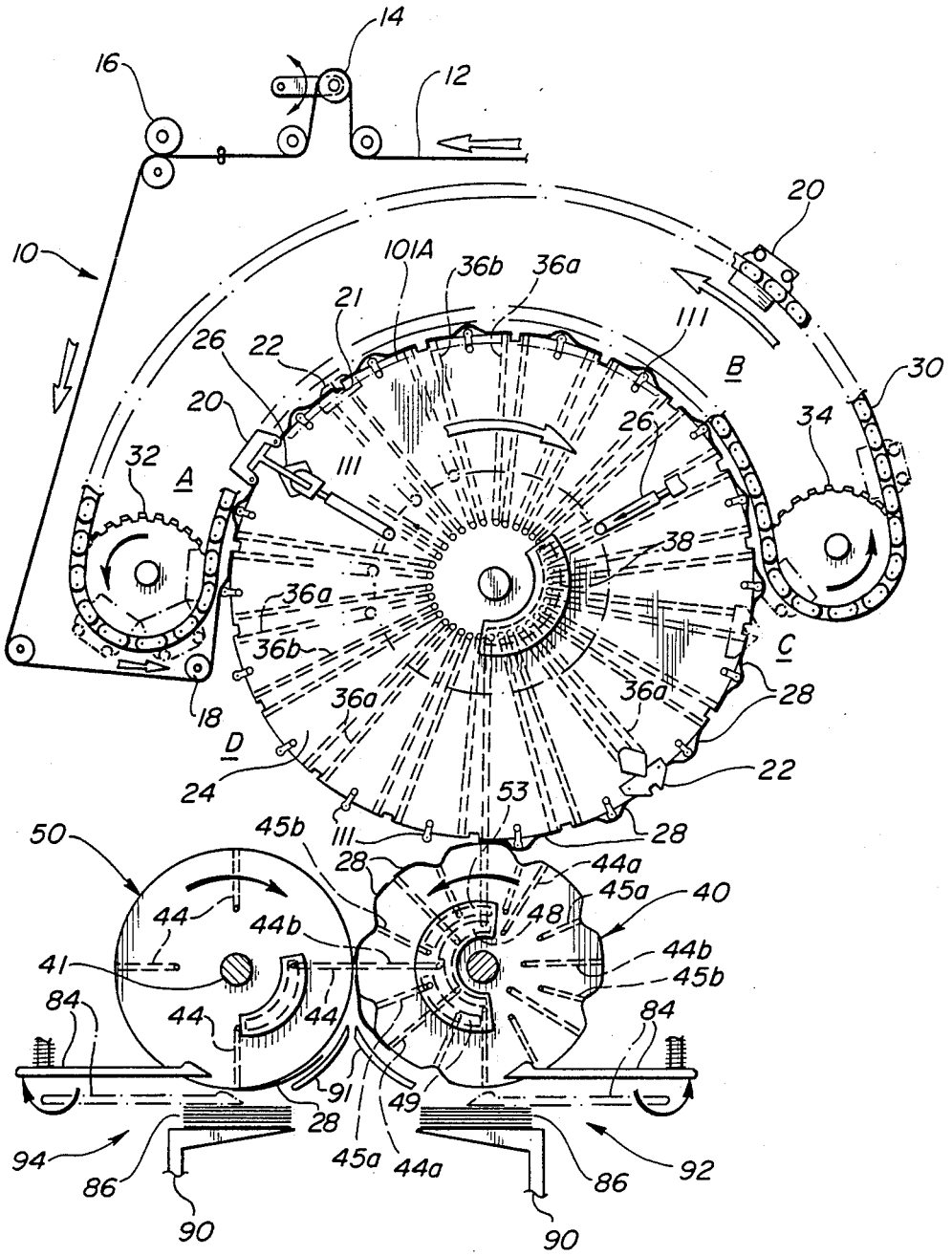
FIG. 2 is a schematic side elevational view of a second embodiment of the apparatus of the present invention.
Figure 3:
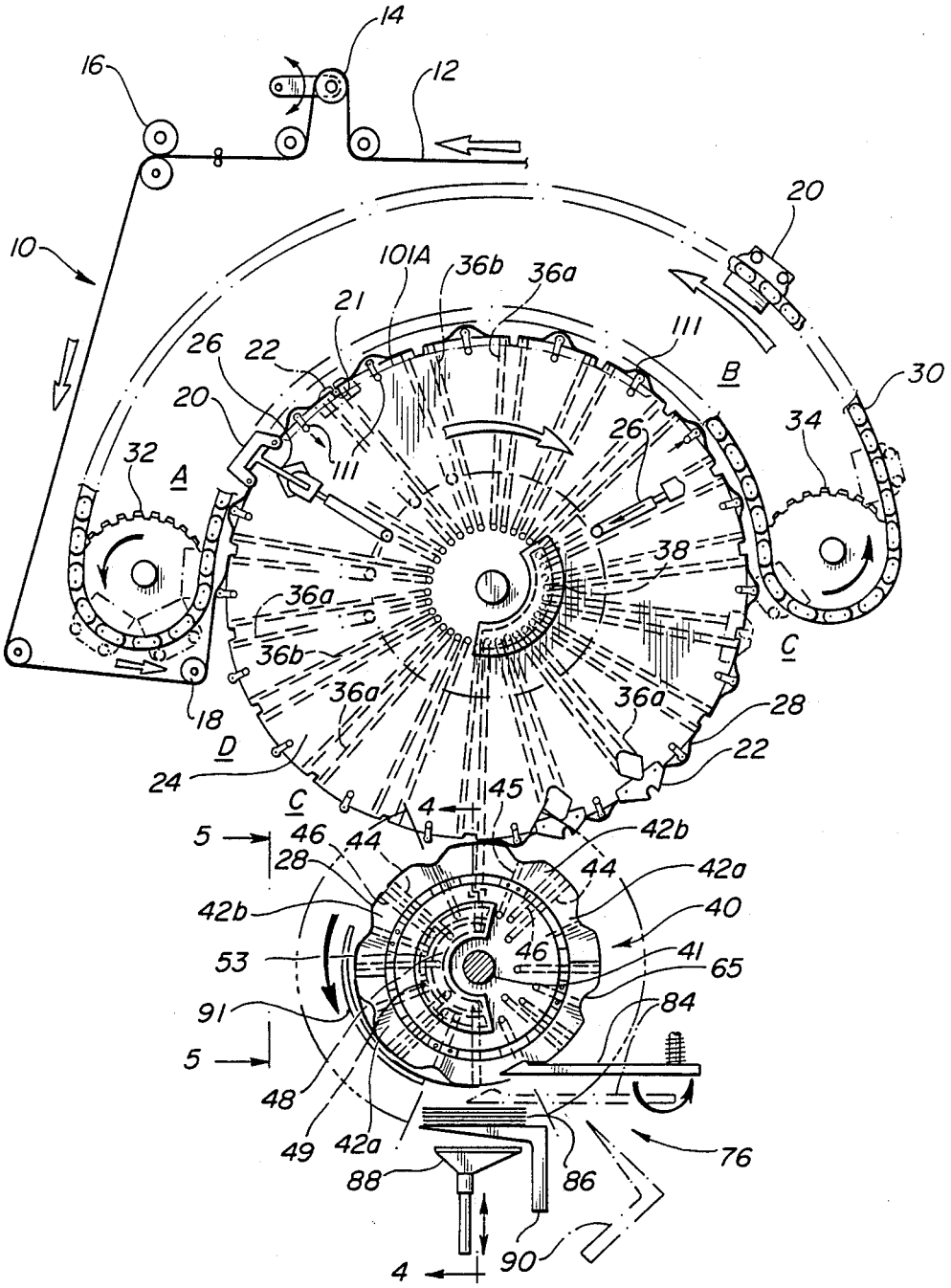
FIG. 3 is a schematic side elevational view of a third embodiment of the apparatus of the present invention.

Conventional means for vacuum retention of the products are provided in the product and transfer drums. In the embodiments of FIGS. 1, 2 and 3, illustrated by reference to FIG. 3, individual bags 28 are held in position on the rotating product drum 24 by a pair of vacuum ports, **36*a* and 36*b*, which communicate with a central manifold 38. Central manifold 38 in turn communicates with a vacuum source (not shown). As product drum 24 rotates, vacuum ports 36*a* and 36*b* are brought into and out of communication with manifold 38, causing a vacuum to be applied to the leading and trailing edges of bags 28 beginning at a point just prior to the removal of seal bar assembly 20 until just prior to transfer of the bags to transfer drum 40**.

Figure 4:
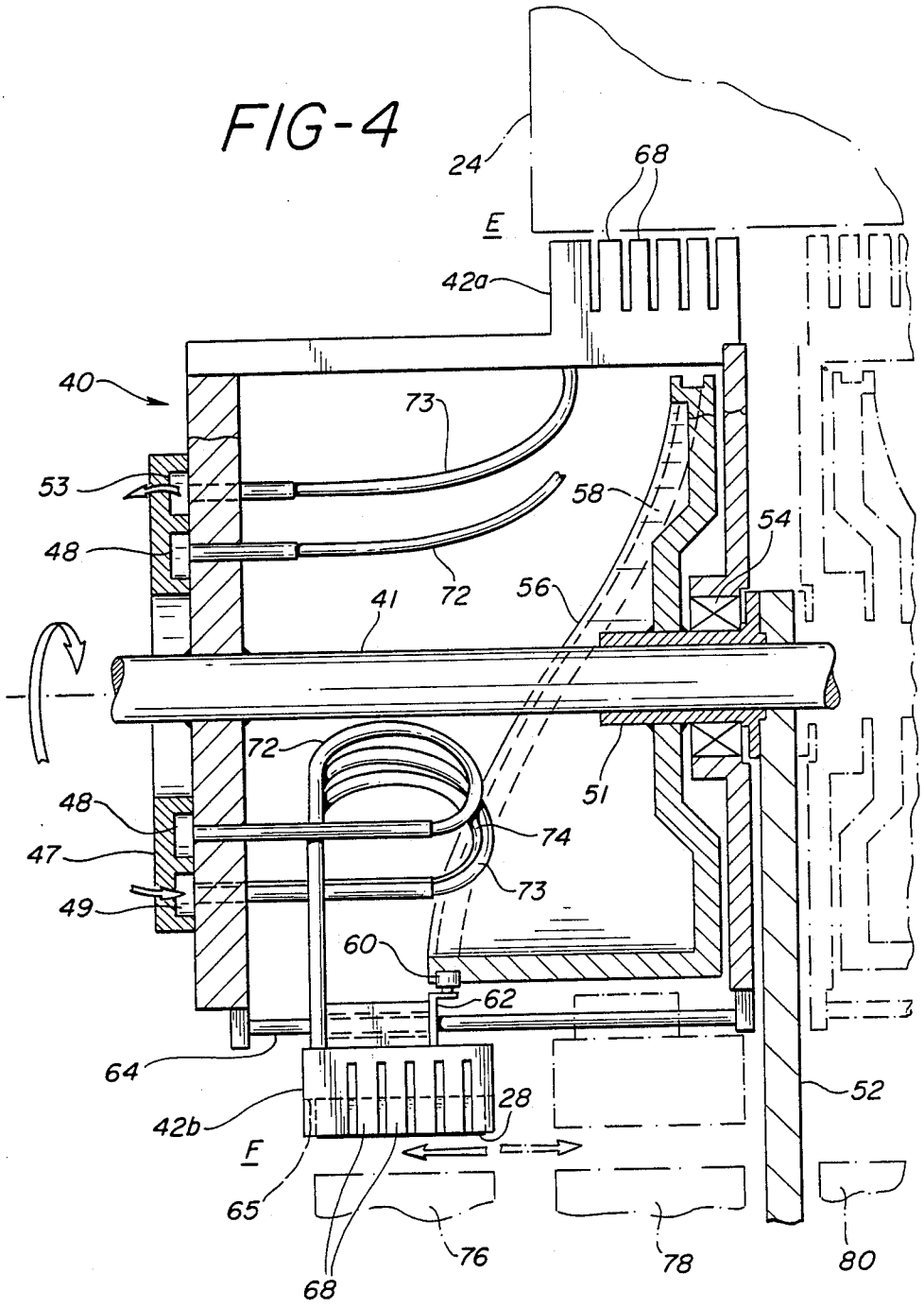
FIG. 4 is a cross-sectional view, taken along section line 4—4 in FIG. 3 illustrating one half of the transfer device of the present invention.
Figure 5:
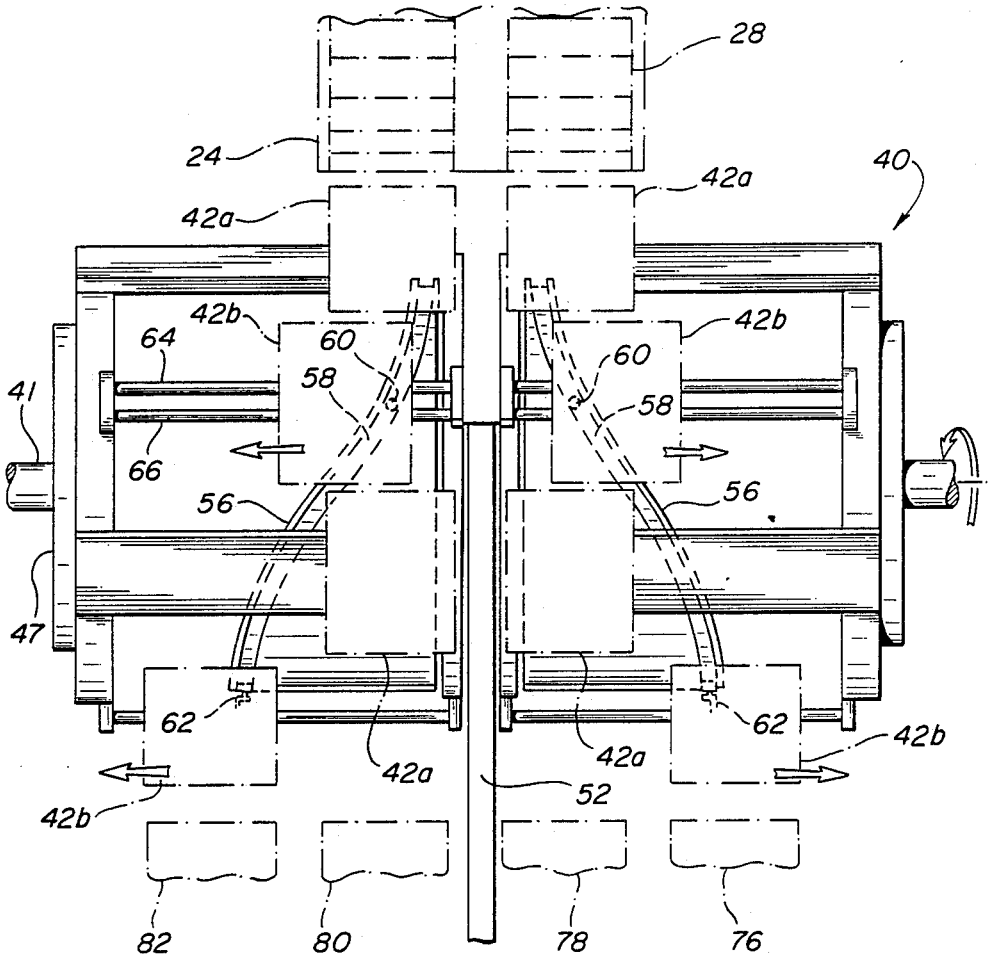
FIG. 5 is a side elevational view of the transfer device taken along line 5—5 in FIG. 2.

In the embodiment of FIG. 3, transfer drum 40 is driven by suitable drive means (not shown) through shaft 41. Alternatively, shaft 41 may be fixed, and transfer drum 40 rotated about the shaft. As shown in FIGS. 3 to 5, transfer drum 40 includes a plurality of segments **42*a* and 42*b*. It is preferable that segments 42*a* and 42*b* alternate about the periphery of the drum with segments 42*a* being fixed while segments 42*b* are movable transversely to the direction of rotation of drum 40. In an alternative embodiment, both segments 42*a* and 42*b*** are fixed.

Figure 12:
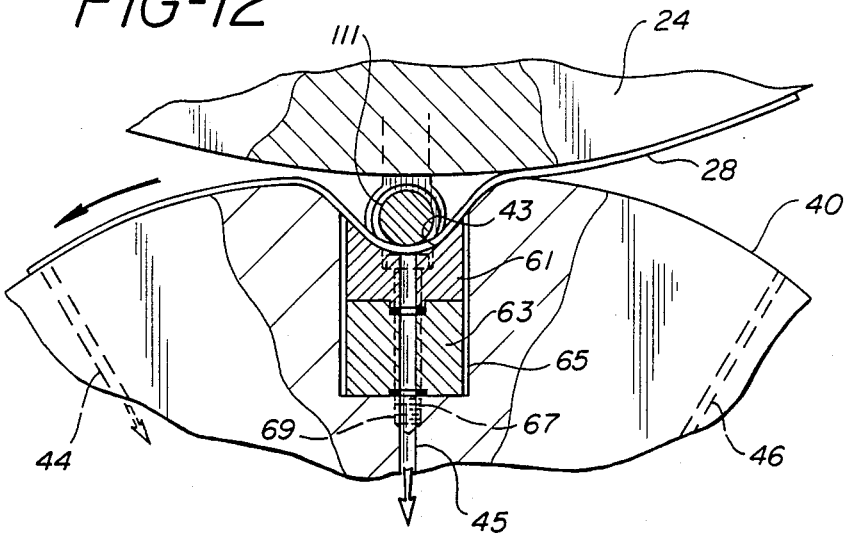
FIG. 12 is an enlarged view of the interface between the product drum and a transfer drum.

As shown in FIGS. 1, 2 and 3, a series of indentations 65 on the transfer drums 40 and 50 correspond in depth with tuck rolls 111 on the product drum 24, and mate with tuck rolls 111 as the product and transfer drums rotate. The preferred embodiment of the indentations 65, best illustrated in FIG. 12, shows that the indentations 65 removably receive inserts 61 and spacer blocks 63, affixed by conventional means, such as bolts 67 screwed into threaded holes 69 machined into the product drums 40 and 50. Spacer blocks 63 permit positioning of inserts 61 to correspond in depth with tuck roll extension. The indentations 65, inserts 61, and spacer blocks 63 include vacuum ports 45 communicating with the second vacuum manifold 53 shown in FIGS. 1, 2 and 3 for securing the bags therein to prevent rewelding of adjacent bag seams.

With reference to the embodiment of FIG. 3, both fixed segments **42*a* and movable segments 42*b* include a first set of vacuum ports 44 in communication with a central manifold 48, and a second set of vacuum ports 45 in communication with a central manifold 53. Manifolds 48 and 53 are in turn in communication with a vacuum source (not shown). Both manifolds 48 and 53 as shown in FIGS. 4 and 5 are part of a housing 47 which is located on the side of drum 40. As shown in FIG. 3, vacuum ports 44 and 45 are positioned to secure the leading edges and mid-sections of each of the respective bags 28 as they are transferred to drum 40**. The mid-sections are secured by vacuum to prevent rewelding of the bags with successive bags as the transfer drum rotates through a given arc. Preferably, the vacuum ports are arrayed across substantially the entire width of the bags.

Segments **42*b* also include a second set of vacuum ports 46 which are also in communication with central manifold 53. Vacuum ports 46 are positioned to secure the trailing edges of bags 28 as they are transferred to drum 40. By securing both the leading edges, mid-sections, and trailing edges of bags 28 to the movable segments, wrinkling or folding of the bags is prevented during transverse movement of segments 42*b***.

While the vacuum ports 46 are shown as a preferred means for securing the trailing edges of bags 28, other suitable means may be employed to accomplish this function. For example, a single vacuum port located on one trailing corner of the bag may be sufficient to secure the trailing edge. Alternatively, vacuum ports may be positioned along a side edge of the bags. Finally, a static charge may be developed on the drum to hold down the trailing edges of the bags.

A close-fitting guide 91 may be positioned just above the surface of the rotating transfer drum to urge the bags to flatten out, or air jets or knives may be positioned to force a stream of air against the bags at an angle which will urge the bags out of the indentations and flatten them for delivery and stacking.

As further shown in FIGS. 2 and 3, transfer drum 40 is positioned directly beneath product drum 24. This positioning provides operating advantages for the system. Because of the high rotational speeds of both drums (up to 500 feet per minute), the length of time available for the cam to side-shift movable segments **42*b* to their outermost position and then return them to their initial positions is quite short. By positioning transfer drum 40 directly beneath product drum 24, the arc length from the transfer point between the two drums to the pick-off point at the packing equipment is approximately equal to the return arc length. In this manner, the transverse movement of the cam will not exceed a critical angle of approximately 20°–25° along any point during the rotation of transfer drum 40. Transfer drum 40 may be positioned more to one side of product drum 24. However, the diameter of transfer drum 40 would need to be increased to provide a sufficient arc length to accommodate the transverse movement of the cam. The configuration shown in FIG. 1** is preferred as it permits the use of two transfer drums of minimum diameter and results in higher production rates.

Referring now to FIGS. 4 and 5, the structure and operation of the side-shifting transfer drum 40 embodiment is illustrated in greater detail. Drum 40 is mounted on drive shaft 41 which is in turn supported in a sleeve 51 secured to center support plate 52. Bearings 54 permit the rotation of drum 40 around fixed sleeve 51. For ease of explanation, only one half of transfer drum 40 is shown in FIG. 4. It will be appreciated that a mirror image of the portion of the drum which is illustrated extends from the opposite side of center support plate 52 as shown in FIG. 5 and is partially shown in phantom lines in FIG. 4.

Referring to FIG. 4, positioned within drum 40 is a cam 56 having a cam track 58. Cam 56 is secured to sleeve 51 by suitable means. A cam follower 60 secured to each movable segment 42*b*, such as by bracket 62, rides in cam track 58. Movable segments 42*b* are also mounted on bearings or the like for transverse movement on rails 64, 66 (best shown in FIG. 5). Rotation of drum 40 about its longitudinal axis causes movable segments 42*b* to translate as shown along rails 64, 66 to move from position E, in alignment with bags from product drum 24 at the transfer point between the two drums, to position F, at the opposite side of transfer drum 40.

Both segments 42*a* and 42*b* have indentations 43 mating with tuck rolls 111 on the product drum. In a preferred form of the side-shifting embodiment, fixed segments 42*a* have finger segments 68 with gaps therebetween to facilitate removal of the bags 28 by the orbital packing fingers on the orbital packing device as described in greater detail below. Flexible vacuum hose 72 supplies a source of vacuum from manifold 48 to vacuum ports 44 on the surface of segments 42*a* to secure the leading edges of bags 28 thereto.

Movable segments 42*b* also preferably include finger segments 68 having gaps therebetween. Flexible vacuum hoses 72, 73 and 74 provide a source of vacuum from manifolds 48, 53 and 53, respectively, to vacuum ports 44, 45 and 46 on the surface of the movable segments. In this manner, both the leading edge, mid-section, and trailing edge of bags 28 are secured to movable segments 42*b*.

In operation, pairs of bags 28 are transferred from continuous streams of bags on product drum 24 to transfer drum 40 as the two drums rotate in opposite directions. At the point of transfer, the vacuum on the leading edge of the bag on the product drum is released, and the bag falls onto transfer drum 40 where the leading edge is immediately secured by vacuum ports 44. It will be understood that for this embodiment of the invention that bags 28 will fall sequentially onto either a fixed segment 42*a* or movable segment 42*b*. As transfer drum 40 continues to rotate, vacuum port 45 will be activated to secure the mid-section of the bag, and if the bag is on a movable segment 42*b*, vacuum ports 46 will be activated to secure the trailing edge of the bag.

As shown in FIG. 5, as drum 40 rotates, both fixed and movable segments 42*a* and 42*b* are positioned directly beneath the transfer point on product drum 24. As drum 40 continues to rotate, movable segments 42*b* will begin to translate laterally as cam 56 causes cam follower 60 to move laterally in cam track 58. At a predetermined point in the rotation of drum 40, movable segments 42*b* are at their outwardmost position on drum 40, in alignment with packing devices 76 and 82, respectively Fixed segments 42*a* continue to rotate in alignment with packing devices 78 and 80 respectively.

As illustrated in FIG. 3, the predetermined point at which movable segments 42*b* reach their outwardmost travel is approximately 180 degrees from the transfer point between drums 24 and 40. Cam 56 is designed so that after reaching the point of outermost travel and transferring the bags to the packing equipment, movable segments 42*b* begin to translate inwardly so that they are back into alignment with the streams of bags leaving product drum 24 by the time that drum 40 rotates them back to that position.

Figure 13:
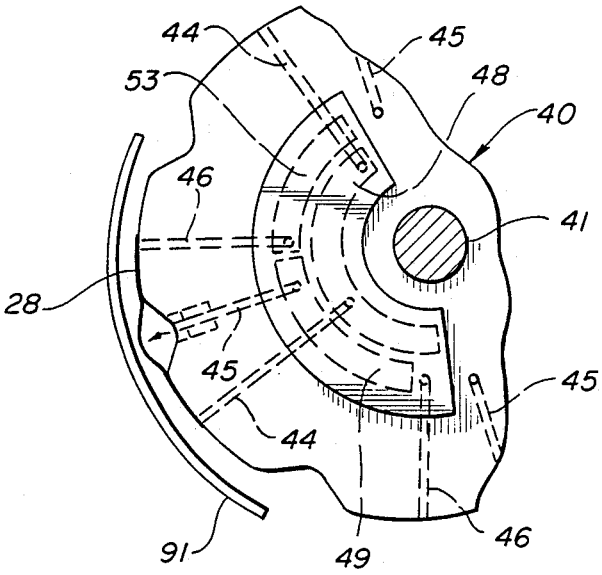
FIG. 13 is a schematic side view of the transfer drum showing vacuum and positive pressure manifolding.
Figure 14:
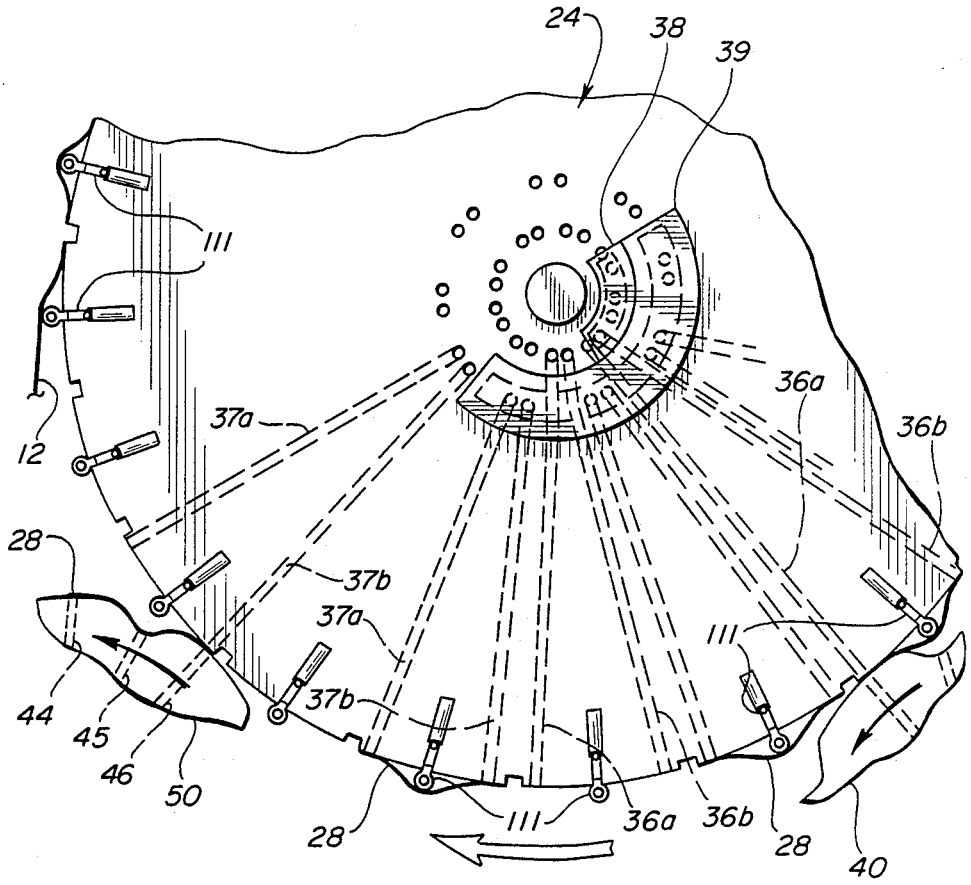
FIG. 14 is a schematic side view of the product drum showing vacuum and positive pressure manifolding.

In this manner, the two streams of individual bags shown in FIG. 5 may be divided into four streams which can then be delivered to separate packing devices 76, 78, 80, and 82. The operation of those packing devices are the same and will be described in greater detail in relation to device 76 as best shown in FIG. 3. Referring to FIG. 3, as bags 28 are brought around transfer drum 40, vacuum ports 44 retain the leading edges of the bags 28 until they reach a nearly horizontal position where the vacuum is released. Vacuum ports 45 and 46 hold onto the mid-sections and trailing edges of the bags 28 until they reach a generally vertical position at which time vacuum is released and a close-fitting guide 91 may contact the trailing edges of the bags to urge them from the indentations and flatten them out. The preferred embodiment also provides atmospheric or positive air pressure from manifold 49 to help urge the bags 28 from the indentations. Vacuum and positive pressure manifolding of the transfer drum is shown schematically in FIG. 13.

In the packing devices of FIGS. 1, 2 and 3, illustrated by reference to FIG. 3, orbital packer fingers 84 pull the individual bags away from the drum surface and deposit the bags into a stack 86 on delivery table 88. At a precise time, count fingers 90 pivot between the position shown in phantom lines completely out of the stream of bags into the position shown to separate the stack 86 of bags into the desired count. The delivery table 88 may be lowered to permit a clamp assembly (not shown) to clamp the stack of bags and transfer it to further conventional equipment for packaging the bags.

It will be apparent, however, that the cam and movable segments may be designed to translate the segments so that the transfer point between drum 40 and the packing devices occurs at some other point during rotation of drum 40. Additionally, while the invention has been described with reference to a system which divides two streams of products into four streams, it will be apparent that other cam arrangements may be designed to produce additional lanes or streams of products for delivery to corresponding packing equipment. For example, the transfer drum may be constructed so that every other pair of products is side-shifted in opposite directions so that a first pair is side-shifted at least one product width to one side while a succeeding product pair is then side-shifted at least one product width to the opposite side. Alternatively, a dual station transfer drum similar to the embodiment illustrated may be designed so that movable drum segments on one side of the drum are aligned with nonmovable segments on the other side. Other arrangements are also possible and within the scope of the invention.

In the preferred embodiment of the invention illustrated in FIG. 1, where like reference numerals represent like elements, first and second transfer drums 40 and 50, respectively, are positioned at different transfer points around the periphery of product drum 24. As shown in this embodiment, product drum 24 is equipped with a first set of vacuum ports 36*a* and 36*b* as well as a second set of ports 37*a* and 37*b*. Each set of ports communicates with a respective central manifold 38, 39. With the product and transfer drums rotating in the directions indicated by the arrows, it can be seen that the vacuum on ports 36*a* and 36*b* is released at a point approximately along the centerline between the product drum 24 and first transfer drum 40.

Bags 28 transferred to first transfer drum 40 are then delivered to packing device 92 for stacking and counting as previously described. That portion of the bags which are held by ports 37*a* and 37*b* are carried with product drum 24 until the vacuum is released at a point approximately along the centerline between product drum 24 and second transfer drum 50. Again, bags which are released to second transfer drum 50 are then delivered to packing device 94 for stacking and counting. Vacuum retention and release, and delivery of bags by the product drum for packing is accomplished in the same manner as detailed above in the alternative embodiment of FIG. 3.

In similar fashion, the embodiment shown in FIG. 2 transfers bags to two transfer drums 40 and 50 for stacking and counting. In this case, however, the first transfer drum 40 receives each individual bag 28 from the product drum 24, and the second transfer drum 50 receives alternate ones of the bags from the first transfer drum. The second transfer drum 50 has no indentations and retains the bags by vacuum (Ports 44) at their leading edges. A fixed guide 91 aids in urging the bags thus transferred to lay flat for stacking. Bags remaining on the first transfer drum 40 are retained by vacuum at their leading edges and mid-sections (ports 44*a* and 45*a*) until past the point of intersection with the second transfer drum. Vacuum retention of the bag mid-sections (ports 45*a*) is then released, and the bags are urged to lie flat for stacking by fixed guides 91, positive air pressure, or other means as above.

As will be recognized by those skilled in the art, modifications to the embodiments illustrated in FIGS. 1, 2 and 3 can be made. For example, the FIG. 1 embodiment can be arranged to have a third and/or fourth transfer drum. The vacuum ports on the product drum and each of the transfer drums can be arranged so that a portion of the individual bags are delivered to each transfer drum, and from there to corresponding packaging devices. Such arrangements will be effective to triple or quadruple the production rate from the system without increasing the rate of operation of any of the individual packaging devices.

Further, the various embodiments of the transfer drum are recognized as adaptable for use with product drums of conventional design to prevent rewelding of adjacent bag seals. The indentations can provide a tuck in individual bags delivered flat from the product drum; lateral shifting will spread out bags on the transfer drum; and a plurality of transfer drums will separate alternate bags.

It can also be seen that different width bags may be produced on the product drum, with every other bag being of an alternating width. For example, the spacing between adjacent sever and seal stations on the product drum may be changed so that the spacing corresponds to such alternating widths. Of course, the vacuum ports on both the product drum and first transfer drum would be changed to correspond to the new spacing arrangement. The alternating width bags may then be sent to the transfer drums where bags of each specific width are delivered to a separate packaging device. In this manner, the different width (and thus, volume) bags are separately packed and packaged for use.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. An apparatus for the continuous production of individual flexible products from a folded web of material comprising:

a rotatable product drum having a plurality of sever and seal stations located about the periphery thereof for forming individual products;

a source of continuous folded web of materials;

means for continuously feeding said folded web of material onto the surface of said drum; and compressible means for tucking said web of material outwardly from the periphery of said drum, said compressible means for tucking being positioned between adjacent sever and seal stations.

2. An apparatus as recited in claim 1 wherein said compressible means for tucking comprises a series of tuck rolls having one or more compressible supports.

3. An apparatus as recited in claim 2 wherein said compressible supports are adapted to compress said tuck roll into a cavity in the surface of said product drum.

4. An apparatus as recited in claim 3 wherein said apparatus includes means for detecting the depression of said tuck rolls into the surface of said product drum.

5. An apparatus as recited in claim 2 further comprising means for adjusting the depth of tuck made by said tuck rolls to vary the width of products produced by said apparatus.

6. An apparatus as recited in claim 5 wherein said means for adjusting comprises a means for fastening said bracket to said product drum at one of a series of points along a radius, whereby the point of contact between said cam follower arm and said bracket, may be varied, whereby the depth of tuck may be varied.

7. An apparatus as recited in claim 5 wherein said means for adjustment comprises an adjustable stop plate attached to said bracket adapted to vary the effective length of said bracket and the depth of tuck.

8. An apparatus as recited in claim 1 wherein said compressible means for tucking comprises a tuck roll and one or more bracket, spring, and housing support assemblies.

9. An apparatus as recited in claim 8 wherein said spring biases said tuck roll towards a position of maximum extension.

10. An apparatus as recited in claim 8 wherein said spring is adapted to allow compression of said tuck roll into a cavity in the surface of said product drum.

11. An apparatus as recited in claim 8, wherein two of said support assemblies support each of said tuck rolls.

12. An apparatus as recited in claim 8 wherein said housings contain bearings to enhance radial movement of said brackets and tuck rolls.

13. An apparatus as recited in claim 8 wherein said support assemblies further comprise means of adjusting the depth of tuck made by said tuck rolls to vary the width of product produced by said apparatus.

14. An apparatus as recited in claim 13 wherein said means for adjusting comprises means for fastening said housings to said product drum at one of a series of points along a radius, whereby the depth at which said support assemblies are mounted and the depth of tuck may be varied.

15. An apparatus as recited in claim 13 wherein said means for adjusting comprises an adjustable stop plate attached to said bracket adapted to vary the effective length of said bracket and the depth of tuck.

16. An apparatus as recited in claim 13 wherein said means for adjusting comprises replaceable tuck roll bearing blocks attached to said bracket adapted to vary the depth of tuck by changing the size of said bearing blocks supporting said tuck rolls.

17. An apparatus as recited in claim 13 wherein said means for adjusting comprises replaceable brackets of different lengths adapted to vary the depth of tuck by changing the length of said brackets.

18. An apparatus as recited in claim 8 wherein said apparatus further comprises means for providing tension relief in said web of material.

19. An apparatus as recited in claim 18 wherein said means for providing tension relief comprises one or more fixed cams attached to said product drum and corresponding cam followers attached to said brackets, whereby communication between said cam and said cam follower cause radial displacement of said tuck rolls over a predetermined arc.

20. An apparatus as recited in claim 19 wherein said cam is crescent-shaped.

21. An apparatus as recited in claim 19 wherein said cam followers may be rotatably fastened in one of a series of holes in said brackets to vary the radial displacement of said tuck roll.

22. An apparatus as recited in claim 19 further comprising means for adjusting the depth of tuck made by said tuck rolls, and means for positioning said cam followers at one of a plurality of positions on said brackets to maintain the radial displacement of said tuck roll when the depth of tuck is adjusted.

23. An apparatus as recited in claim 1 further comprising means to adjust the extension of said tuck rolls to vary the width of product produced by said apparatus.

24. An apparatus as recited in claim 1 further comprising means for providing tension relief in said web of material.

25. An apparatus as recited in claim 1 wherein said means for continuously feeding said folded web of material onto the surface of said product drum includes a plurality of seal bar assemblies whereby material is clamped onto the surface of said product drum at each of said sever and seal stations.

26. An apparatus as recited in claim 25 wherein said seal bar assemblies include pivot shafts having rounded edges at each edge where contact with said web material occurs.

27. An apparatus as recited in claim 25 where said apparatus further comprises a means for providing tension relief in said web of material, said means for providing tension relief comprising one or more fixed cams attached to said product drum, and corresponding cam follower assemblies attached to each of said seal bar assemblies, whereby said cam and said cam follower assemblies cause radial displacement of said tuck rolls over a predetermined arc.

28. An apparatus as recited in claim 27 wherein said compressible means for tucking comprise a tuck roll and one or more bracket, spring, and housing support assemblies, and each of said cam follower assemblies comprise a cam follower, cam follower arm, and means for pivotally fastening said cam follower arm to said seal bar assembly, whereby communication between said cam and said cam follower causes said cam follower arm to pivot and the opposite end of said cam follower arm to contact said bracket, causing radial displacement of said tuck rolls.

29. An apparatus as recited in claim 27 wherein said cam is crescent-shaped.

30. An apparatus as recited in claim 29 wherein said means for adjusting comprises replaceable tuck roll bearing blocks attached to said bracket adapted to vary the depth of tuck by changing the size of said bearing blocks supporting said tuck rolls.

31. An apparatus as recited in claim 29 wherein said means for adjusting comprises replaceable brackets of different lengths adapted to vary the depth of tuck by changing the length of said brackets.

32. An apparatus as recited in claim 1 further comprising:

means for transferring individual flexible products from said product drum sequentially to a plurality of transfer points.

33. An apparatus as recited in claim 32 wherein said means for transferring comprises a plurality of rotatable vacuum transfer drums, having means for accepting said individual flexible products arranged such that the first of said plurality of transfer drums accepts individual products from said vacuum product drum at a first transfer point, and each succeeding transfer drum accepts individual products from said vacuum product drum at each succeeding transfer point, said first transfer drum delivering at least a portion of said individual products to a first delivery point, and each succeeding transfer drum located at each succeeding transfer point delivering at least a portion of said individual products to succeeding delivery points;

means for rotating said vacuum transfer drums; and a vacuum source including first and second manifolds.

34. An apparatus as recited in claim 33 wherein said means for accepting said individual flexible products comprises a series of indentations on the surface of said transfer drums mating with said tuck rolls as said product and transfer drums rotate;

vacuum ports in communication with said first manifold for securing the leading edges of said products; and vacuum ports in communication with said second manifold for securing the mid-sections of said products in said indentations.

35. An apparatus as recited in claim 34, further comprising:

means for varying the depth of said indentations said means for varying including means for removably receiving inserts and spacer blocks of different discrete sizes, said indentations, inserts and spacer blocks including ports communicating with said second vacuum manifold.

36. An apparatus as recited in claim 34, further comprising means for urging said flexible products outwardly from said indentations prior to said products reaching said delivery point.

37. An apparatus as recited in claim 34 wherein each of said plurality of transfer drums includes a positive air pressure manifold, and said means for urging said flexible products outwardly comprises positive air pressure communicated from said positive air pressure manifold to said products by said ports in said indentations.

38. An apparatus as recited in claim 34 further including a close-fitting guide positioned adjacent the surface of each of said transfer drums to urge said products to flatten outwardly as vacuum is released from the midsection of said products.

39. The apparatus of claim 34 further comprising means located at each of said delivery points for removing individual flexible products from each of said transfer drums.

40. The apparatus of claim 33 wherein said plurality of rotatable vacuum transfer drums comprises two transfer drums, and said product drum transfers every other one of said products from said product drum to said first transfer drum and the remaining products to said second transfer drum.

41. An apparatus as recited in claim 32, wherein said means for transferring comprises a plurality of rotatable vacuum transfer drums having means for accepting said individual flexible products arranged such that the first of said plurality of transfer drums accepts each individual product from said vacuum product drum, and each succeeding transfer drum accepts alternate ones of said products from the preceeding transfer drum, said first transfer drum delivers at least a portion of said individual products to a first delivery point, and each succeeding transfer drum delivers at least a portion of said individual products to succeeding delivery points;

means for rotating said vacuum transfer drums; and a vacuum source including first and second manifolds.

42. An apparatus as recited in claim 41 wherein said means for accepting each of said individual flexible products on said transfer drum comprises a series of indentations on the surface of said first transfer drum, said indentations mating with said tuck rolls as said product and transfer drums rotate, vacuum ports in communication with said second manifold for securing said flexible products in said indentations of said first transfer drum;

vacuum ports in communication with said first manifold for securing the leading edges of said products on the first drum; and vacuum ports on the surface of the succeeding transfer drums in communication with said first manifold for securing the leading edges of said products transfered to said succeeding transfer drum.

43. An apparatus as recited in claim 42 further comprising:

means for varying the depth of said indentations in said first transfer drum, said means for varying including means for removably receiving inserts and spacer blocks of different discrete sizes, and said indentations, inserts and spacer blocks including ports communicating with said second vacuum manifold.

44. An apparatus as recited in claim 42 further comprising means for urging said flexible products outwardly from said indentations prior to said products reaching said delivery point.

45. An apparatus as recited in claim 42 wherein said first transfer drum includes a positive air-pressure manifold, and said means for urging said flexible products outwardly comprises positive air pressure communicated from said positive air pressure manifold to said products by said ports in said indentations.

46. An apparatus as recited in claim 42 wherein close-fitting guides positioned adjacent to the surface of each of said transfer drums urges said flexible products to flatten outwardly.

47. An apparatus as recited in claim 41 further comprising means located at each of said delivery points for removing individual products from said transfer drum.

48. An apparatus for the continuous production of individual flexible products from a folded web of material comprising:

a rotatable product drum having a plurality of sever and seal stations located about the outer periphery thereof for forming individual products;

a source of continuous folded web material;

means for continuously feeding said folded web of material onto the surface of said drum; and means positioned between adjacent sever and seal stations for tucking said web of material outwardly from the periphery of said drum, said means comprising a series of tuck rolls having means for extending above the surface of said drum throughout the rotation of said drum.

49. An apparatus as recited in claim 48 further comprising means to adjust the extension of said tuck rolls to vary the width of product produced by said apparatus.

50. An apparatus as recited in claim 48 further comprising means for providing tension relief in said web of material.

51. An apparatus as recited in claim 48 wherein said means .for extension above the surface of said drum comprises:

one or more assemblies comprising a bracket, housing and cam follower, and one or more cams having cam tracks in cooperation with said cam follower.

52. An apparatus as recited in claim 51 wherein said means for extension further comprises means-to adjust the extension of said tuck rolls to vary the width of product produced by said apparatus.

53. An apparatus as recited in claim 52 wherein said means for adjusting extension comprises adjustable brackets.

54. An apparatus as recited in claim 52 wherein said means for adjusting extension comprises replaceable segments of said brackets.

55. An apparatus as recited in claim 52 wherein said means for adjusting extension comprises a second cam track in said cam.

56. An apparatus as recited in claim 51 wherein said apparatus further comprises means for providing tension relief.

57. An apparatus as recited in claim 56 wherein said means for providing tension relief comprises a defined cam track profile cut in said cam to retract said tuck rolls over a predetermined arc.

58. An apparatus as recited in claim 48 wherein said bracket further comprises a spring-loaded element adapted to compress said tuck rolls.

59. An apparatus as recited in claim 58 wherein said spring-loaded element is adapted to allow compression of said tuck roll into a cavity in the surface of said product drum.

60. An apparatus as recited in claim 59 wherein said apparatus includes means for detecting the compression of said tuck rolls into the surface of said drum.

61. A method for the continuous production of flexible products comprising the steps of:

providing a source of a continuous web of material;

continuously feeding said web onto the periphery of a rotating product drum;

tucking said web outwardly over a plurality of compressible tuck rolls extending above the surface of said rotating product drum while clamping said web between said tuck rolls;

retracting said tuck rolls to provide tension relief in said web;

severing and sealing said web to form individual flexible products.

62. A method for the continuous production of flexible products as recited in claim 61 further comprising the step of:

transferring said individual flexible products from said product drum sequentially to one or more delivery points.

* * * * *